US009315913B2

(12) United States Patent
Sekimoto et al.

(10) Patent No.: US 9,315,913 B2
(45) Date of Patent: Apr. 19, 2016

(54) FORMIC ACID GENERATION APPARATUS AND METHOD

(71) Applicant: Panasonic Corporation, Osaka (JP)

(72) Inventors: Takeyuki Sekimoto, Osaka (JP); Masahiro Deguchi, Osaka (JP); Satoshi Yotsuhashi, Osaka (JP); Hiroshi Hashiba, Osaka (JP); Yuka Yamada, Nara (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/492,087

(22) Filed: Sep. 22, 2014

(65) Prior Publication Data

US 2015/0152564 A1 Jun. 4, 2015

(30) Foreign Application Priority Data

Dec. 3, 2013 (JP) ..... 2013-249801

(51) Int. Cl.
*C25B 3/04* (2006.01)
*C25B 11/04* (2006.01)

(52) U.S. Cl.
CPC ..... *C25B 11/0452* (2013.01); *C25B 3/04* (2013.01)

(58) Field of Classification Search
CPC ..... C25B 3/00; C25B 3/04; C25B 15/00; B01J 23/08
USPC ..... 205/440; 204/242
See application file for complete search history.

(56) References Cited

U.S. PATENT DOCUMENTS

2012/0228147 A1* 9/2012 Sivasankar et al. ..... 205/440
2012/0292199 A1 11/2012 Deguchi et al.

FOREIGN PATENT DOCUMENTS

JP 5017499 6/2012
JP 2012-192302 10/2012
JP 2013-129883 7/2013
WO 2009/157454 12/2009

OTHER PUBLICATIONS

Hideo Tsuneoka et.al "Adsorbed Species of CO2 and H2 on Ga2O3 for the Photocatalytic Reduction of CO2" J. Phys. Chem. C, 2010, vol. 114, p. 8892-8898.

* cited by examiner

*Primary Examiner* — Bryan D. Ripa
*Assistant Examiner* — Leo Ahnn
(74) *Attorney, Agent, or Firm* — McDermott Will & Emery LLP

(57) ABSTRACT

In a method for generating formic acid by reducing carbon dioxide, a formic acid generation apparatus is prepared. The apparatus includes: a cathode container for storing a first electrolyte solution containing carbon dioxide; an anode container for storing a second electrolyte solution; a solid electrolyte membrane sandwiched between the cathode and anode containers; a cathode electrode provided in the cathode container in contact with the first electrolyte solution, the cathode electrode having a gallium oxide region on a surface thereof; an anode electrode provided in the anode container in contact with the second electrolyte solution; and an external power supply for applying a negative voltage and a positive voltage to the cathode electrode and the anode electrode, respectively. A negative voltage and a positive voltage are applied to the cathode electrode and the anode electrode, respectively, using the external power supply to generate formic acid on the cathode electrode.

3 Claims, 2 Drawing Sheets

FORMIC ACID GENERATION APPARATUS AND METHOD

BACKGROUND 1. Technical Field

The present invention relates to a formic acid generation apparatus and a formic acid generation method using a cathode electrode having a region formed of gall urn oxide.

2. Description of the Related Art

United States Pre-Grant Patent Application Publication No. 2012/0292199A discloses a method for generating a carbon dioxide reduction product such as methane, ethylene, ethane, or formic acid using an electrochemistry cell comprising a working electrode containing a catalyst formed of zirconium carbide.

Japanese Patent laid-open Publication No. 2012-192302A discloses a method for reducing carbon dioxide by irradiating a gallium oxide photocatalyst supporting silver with light to generate carbon monoxide.

Hideo Tsuneoka, Kentaro Teramura, Tetsuya Shishido, and Tsunehiro Tanaka, "Adsorbed Species of $CO_2$ and $H_2$ on $Ga_2O_3$ for the Photocatalytic Reduction of $CO_2$", J. Phys. Chem. C, 2010, vol. 114, p. 8892-8898 discloses a method for reducing carbon dioxide by irradiating a catalyst formed of gallium oxide with light to generated carbon monoxide.

SUMMARY

The present invention provides a formic acid generation apparatus for generating formic acid by reducing carbon dioxide, comprising:

a cathode container for storing a first electrolyte solution containing carbon dioxide;

an anode container for storing a second electrolyte solution;

a solid electrolyte membrane sandwiched between the cathode container and the anode container;

a cathode electrode provided in the cathode container so as to be in contact with the first electrolyte solution, the cathode electrode having a gallium oxide region on a surface thereof;

an anode electrode provided in the anode container so as to be in contact with the second electrolyte solution; and an external power supply for applying a negative voltage and a positive voltage to the cathode electrode and the anode electrode, respectively.

The present invention further provides a method for generating formic acid by reducing carbon dioxide, the method comprising:

(a) preparing the formic acid generation apparatus; and (b) applying a negative voltage and a positive voltage to the cathode electrode and the anode electrode, respectively, using the external power supply to generate formic acid on the cathode electrode.

The formic acid generation apparatus and method according to the present invention generate formic acid efficiently as a carbon dioxide reduction product.

DETAILED DESCRIPTION OF THE EMBODIMENT (First Embodiment)

Hereinafter, an embodiment of the present invention will be described with reference to the drawings.

(Formic Acid Generation Apparatus 100)

Figure 1:
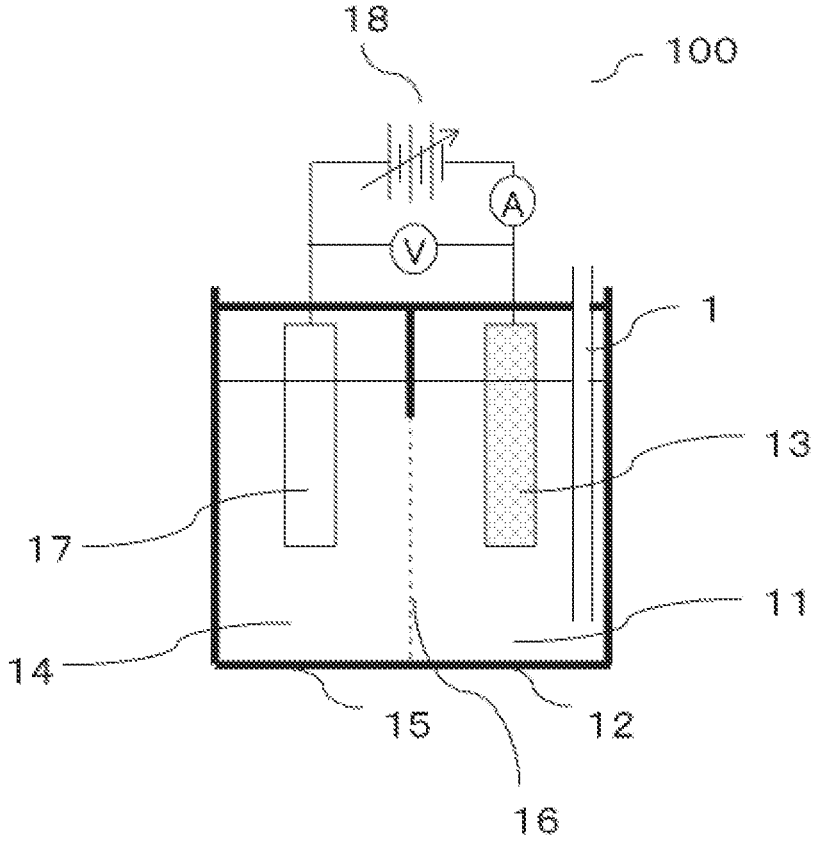
FIG. 1 shows a schematic view of a formic acid generation apparatus according to a first embodiment.

FIG. 1 is a schematic view of a formic acid generation apparatus 100 according to the first embodiment. The formic acid generation apparatus 100 comprises a cathode container 12, a cathode electrode 13, an anode container 15, a solid electrolyte membrane 16, an anode electrode 17, and an external power supply 18.

A first electrolyte solution 11 is stored in the cathode container 12. The cathode container 12 comprises the cathode electrode 13. At least a part of the cathode electrode 13 is in contact with the first electrolyte solution 11. Desirably, at least a part of the cathode electrode 13 is immersed in the first electrolyte solution 11.

The first electrolyte solution 11 is an electrolyte aqueous solution. An example of the first electrolyte solution 11 is a potassium chloride aqueous solution or a sodium chloride aqueous solution. Furthermore, the first electrolyte solution 11 contains carbon dioxide. The concentration of carbon dioxide is not limited. It is desirable that the first electrolyte solution 11 is mildly acidic in the state where carbon dioxide is dissolved in the first electrolyte solution 11.

Carbon dioxide is reduced on the surface of the cathode electrode 13. The cathode electrode 13 has a gallium oxide region on the surface thereof. Gallium oxide is an oxide semiconductor having an electron affinity of 2.5 eV. The band edge level at the bottom of the conduction band of gallium oxide is higher than the oxidation-reduction potential of formic acid/carbon dioxide. For this reason, formic acid is generated efficiently as the carbon dioxide reduction product in a case where the cathode electrode 13 has the gallium oxide region. An example of the cathode electrode 13 is a polycrystalline or single-crystal gallium oxide substrate. The cathode electrode 13 may be composed only of gallium oxide. However, the cathode electrode 13 may have a stacked structure of a substrate and a conductive layer. An example of such a cathode electrode 13 is a stacked structure of the substrate/the conductive layer/the gallium oxide layer. An example of the substrate is a glass substrate or a glassy carbon substrate. The conductive layer may be a conductive layer in which metal or a metal compound is formed in a form of a thin film or a particle. Instead, the conductive layer may be a conductive layer formed by adhering a metal thin film or a metal compound thin film on the substrate. Gallium oxide may be formed on the substrate or the conductive layer in a form of a thin film or a particle. As long as the cathode electrode 13 has an ability of sufficiently reducing carbon dioxide, the constitution of the cathode electrode 13 is not limited.

When the gallium oxide region included in the cathode electrode 13 has high electrical resistance, a current is prevented from flowing. This prevents carbon dioxide from being reduced on the cathode electrode 13. For this reason, it is desirable that a dopant is added to the gallium oxide region to decrease the value of the electrical resistance. The dopant is not limited, as far as the conductivity of gallium oxide is maintained. An example of the dopant is tin or silicon. The concentration of the dopant contained in gallium oxide may be a concentration which satisfies the condition where gallium oxide is a degenerated semiconductor. As an example, it is desirable that the concentration of the dopant contained in gallium oxide is not less than $1\times10^{19}$ $cm^{-3}$.

When a gallium oxide crystal has oxygen defects, the gallium oxide region composed of such a gallium oxide crystal has low electrical resistance. The oxygen defects may occur by adjusting an introduction amount of oxygen or a sintering temperature at the time of fabricating the cathode electrode 13.

Also when the gallium oxide region has a significantly small thickness, the gallium oxide region has low electrical resistance. Also when gallium oxide particles each have a significantly small particle size, the gallium oxide region composed of such gallium oxide particles has low electrical resistance.

Since the cathode electrode 13 having the gallium oxide region on the surface thereof has better water resistance and chemical resistance than a cathode electrode having an indium region on the surface thereof, the cathode electrode 13 having the gallium oxide region on the surface thereof is hardly corroded by formic acid. Since the cathode electrode 13 having the gallium oxide region on the surface thereof is not oxidized even under a high temperature, such a cathode electrode 13 can be used even under a high temperature.

A second electrolyte solution 14 is stored in the anode container 15. The anode container 15 comprises the anode electrode 17. At least a part of the anode electrode 17 is in contact with the second electrolyte solution 14. Desirably, the anode electrode 17 is immersed in the second electrolyte solution 14.

The second electrolyte solution 14 is an electrolyte aqueous solution. An example of the second electrolyte solution 14 is a sodium hydroxide aqueous solution or a potassium hydrogen carbonate aqueous solution. It is desirable that the second electrolyte solution 14 is basic. The solute of the first electrolyte solution 11 may be same as the solute of the second electrolyte solution 14. However, desirably, the solute of the first electrolyte solution 11 is different from the solute of the second electrolyte solution 14.

The anode electrode 17 has a region of a conductive material. Unless the conductive material is decomposed due to an oxidation reaction generated in the anode electrode 17, the conductive material is not limited. An example of the conductive material is carbon, platinum, gold, silver, copper, titanium, iridium oxide, or an alloy thereof. In the formic acid generation apparatus 100 according to the first embodiment, the oxidation reaction of water generated in the anode container 15 is a different and independent reaction system from the reduction reaction of carbon dioxide generated in the cathode container 12. In other words, the reaction generated in the cathode container 12 is not affected by the ingredient of the conductive material included in the anode electrode 17.

The solid electrolyte membrane 16 is sandwiched between the cathode container 12 and the anode container 15 to separate the first electrolyte solution 11 from the second electrolyte solution 14. In other words, in the formic acid generation apparatus 100 according to the first embodiment, the first electrolyte solution 11 is not mixed with the second electrolyte solution 14. The solid electrolyte membrane 16 is a proton-permeable membrane. The solid electrolyte membrane 16 connects the first electrolyte solution 11 to the second electrolyte solution 14 electrically.

Each of the cathode electrode 13 and the anode electrode 17 has an electrode terminal. These electrode terminals are connected to the external power supply 18 through conducting wires. An example of the external power supply 18 is a battery or a potentiostat. The external power supply 18 applies a negative voltage and a positive voltage to the cathode electrode 13 and the anode electrode 17, respectively. The value of the voltage applied by the external power supply 18 is not limited, as long as the voltage is sufficient for the formic acid generation reaction. The value of the voltage may depend on the material of the cathode electrode 13, the material of the anode electrode 17, the type of the first electrolyte solution 11 and/or the concentration of the first electrolyte solution 11.

(Method for Generating Formic Acid)

Hereinafter, a method for generating formic acid using the formic acid generation apparatus 100 according to the first embodiment will be described.

The formic acid generation apparatus 100 may be placed under a room temperature and an atmospheric pressure. However, the formic acid generation apparatus 100 may be placed under a high pressure environment to raise the reaction rate.

Figure 2:
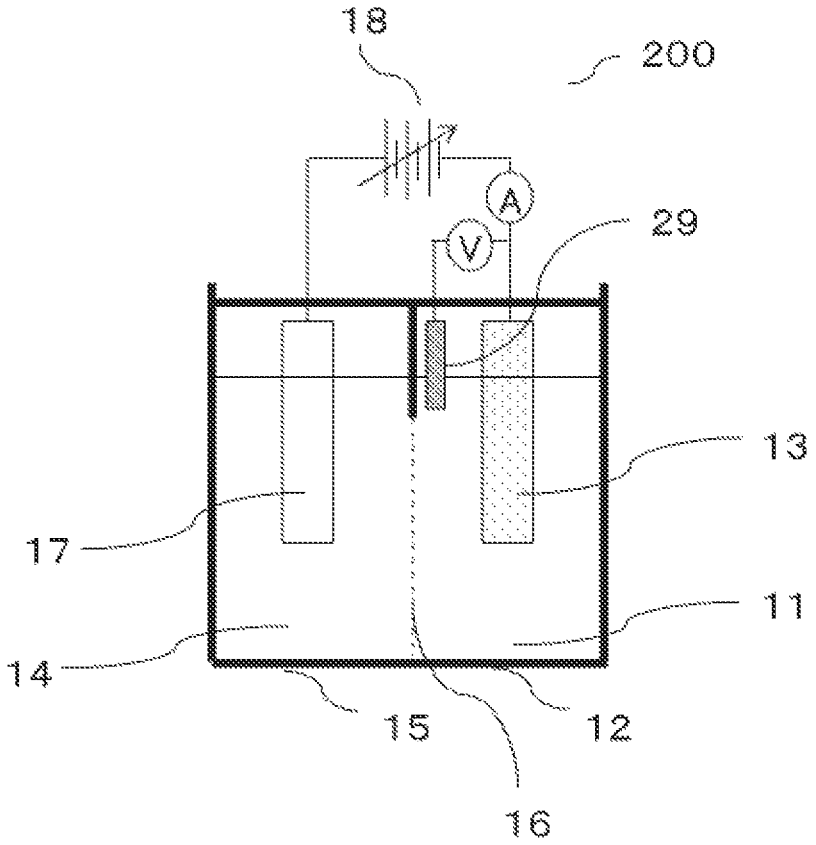
FIG. 2 shows a schematic view of a variation of the formic acid generation apparatus according to the first embodiment.

A voltage is applied using the external power supply 18 in such a manner that the cathode electrode 13 has a negative potential with respect to the potential of the anode electrode 17. A part of the voltage applied to the cathode electrode 13 is consumed for the oxidation reaction of water generated on the anode electrode 17. As shown in FIG. 2, a reference electrode 29 is used to determine the value of the voltage applied to the cathode electrode 13 more accurately. An example of the reference electrode 29 is a silver—silver chloride electrode. It is desirable that that the value of the voltage applied to the cathode electrode 13 is not more than −1.6 eV with respect to the potential value of the reference electrode 29. The value of the voltage applied to the cathode electrode 13 may depend on the material constituting the reference electrode 29.

It is desirable that the formic acid generation apparatus 100 comprises a pipe 1 as shown in FIG. 1. It is desirable that carbon dioxide contained in the first electrolyte solution 11 is reduced, while carbon dioxide is supplied to the first electrolyte solution 11 through the pipe 1. One end of the pipe 1 is immersed in the first electrolyte solution 11. It is desirable that a sufficient amount of carbon dioxide is dissolved in the first electrolyte solution 11 by supplying carbon dioxide to the first electrolyte solution 11 through the pipe 1 before the reduction of carbon dioxide is started. The first electrolyte solution 11 in which carbon dioxide has been dissolved may be supplied to the cathode container 12 through the pipe 1.

As just described, a voltage is applied to the cathode electrode 13 to reduce carbon oxide on the cathode electrode 13. In this way, formic acid is generated as the carbon dioxide reduction product.

In the first embodiment, the cathode container 12 is separated from the anode container 15 using the solid electrolyte membrane 16. This constitution is referred to as "two liquid system". The constitution in which the solid electrolyte membrane 16 is not used is referred to as "one liquid system". In the two liquid system, it is desirable that the second electrolyte solution 14 is selected so that no harmful chlorine gas is generated on the anode electrode 17. Specifically, it is desirable that the second electrolyte solution 14 does not contain chloride ions. In the one liquid system, a reverse reaction in which the generated formic acid is oxidized to be carbon dioxide may occur. In this case, it is desirable that a mechanism for circulating the first electrolyte solution 11 is provided to remove the generated formic acid from the reaction system.

As shown in FIG. 1, the formic acid generation apparatus 100 is provided with a current measurement device to measure a reaction current which flows through the cathode electrode 13.

EXAMPLES

Hereinafter, the present invention will be described in greater detail with reference to the following examples.

Example 1

The overview of the formic acid generation apparatus according to the example 1 is described below.

TABLE 1

| | |
|---|---|
| Cathode electrode | Single-crystal gallium oxide electrode (dopant: Sn, dopant concentration: approximately $1 \times 10^{19}$ $cm^{-3}$) |
| Anode electrode | Platinum electrode |
| Reference electrode | Silver - silver chloride electrode |
| First electrolyte solution | Potassium chloride aqueous solution having a concentration of 3.0 mol/L |
| Second electrolyte solution | Sodium hydroxide aqueous solution having a concentration of 5.0 mol/L |
| Solid electrolyte membrane | Nafion membrane (available from DuPont, trade name: Nafion 117) |

The single-crystal gallium oxide electrode used as a cathode electrode was fabricated as below.

A single-crystal gallium oxide plate having a size of 20 millimeters ×51 millimeters ×0.7 millimeters was prepared. The single-crystal gallium oxide plate contained tin at the concentration of approximately $1\times10^{19}$ $cm^{-3}$ as a dopant. A Ti film was deposited on the single-crystal gallium oxide plate. An Au film was deposited on the Ti film. In this way, a stacked structure of the single-crystal gallium oxide plate/the Ti film/the Au film was obtained.

Then, this stacked structure was adhered on a glass substrate using a copper foil double-coated conductive adhesive tape (available from Teraoka Seisakusho Co. Ltd., trade name: copper foil double-coated conductive adhesive tape No. 792). In this way, obtained was the cathode electrode having a stacked structure of the single-crystal gallium oxide plate/the Ti film/the Au film/the copper foil double-coated conductive adhesive tape/the glass substrate.

Finally, the cathode electrode was coated with epoxy resin such that only the single-crystal gallium oxide region was exposed.

A carbon dioxide gas was supplied to the first electrolyte solution through the pipe for thirty minutes. The flow rate of carbon dioxide was 200 milliliters/minute.

Carbon dioxide was dissolved in the first electrolyte solution, and then, the cathode container was sealed. Subsequently, a voltage was applied between the anode electrode and the cathode electrode using the potentiostat in such a manner that the electric potential of the cathode electrode was negative with respect to the electric potential of the anode to generate an electrolysis reaction. The value of the voltage applied to the cathode electrode was −1.8 volts with respect to the reference electrode. The electrolysis reaction was conducted, until the charge amount was equal to 40 coulombs. The electrolysis time was same as the time during which the voltage was applied to the cathode electrode.

The reaction products generated in the cathode container were identified using gas chromatography and liquid chromatography. As a result, hydrogen ($H_2$), carbon monoxide (CO), methane ($CH_4$), and formic acid (HCOOH) were detected as carbon dioxide reduction products. In this way, the present inventors observed that formic acid was generated on the cathode electrode formed of gallium oxide. The generation efficiency (i.e., faraday efficiency) of formic acid in the example 1 was not less than 80%. This means that formic acid was generated selectively. The faraday efficiency means a ratio of the charge amount used for generation of the reaction product to all the reaction charge amount. Specifically, the faraday efficiency is calculated based on the following mathematical formula (I).

(Faraday efficiency of the reaction product)=(reaction charge amount used for the generation of the reaction product)/(All the reaction charge amount) ×100[%] (I)

Example 2

An experiment similar to the example 1 was conducted, except that the cathode electrode was formed of gallium oxide (dopant: Si, dopant concentration: approximately $1\times10^{19}$ $cm^{-3}$).

Example 3

An experiment similar to the example 1 was conducted, except that the first electrolyte solution was a sodium chloride aqueous solution having a concentration of 0.3 mol/L, and that the value of the voltage applied to the cathode electrode was −2.0 volts with respect to the reference electrode.

Example 4

An experiment similar to the example 1 was conducted, except that the second electrolyte solution was a potassium hydrogen carbonate aqueous solution having a concentration of 0.5 mol/L.

The following Table 2 and Table 3 show the results of the examples 1-4.

TABLE 2

| | Dopant | First electrolyte solution | Second electrolyte solution |
|---|---|---|---|
| Example 1 | Sn | 3.0M KCl | 5.0M NaOH |
| Example 2 | Si | 3.0M KCl | 5.0M NaOH |
| Example 3 | Sn | 0.3M KCl | 5.0M NaOH |
| Example 4 | Sn | 3.0M KCl | 0.5M $KHCO_3$ |

TABLE 3

| | Faraday efficiency | | | |
|---|---|---|---|---|
| | $H_2$ | CO | $CH_4$ | HCOOH |
| Example 1 | 12.87 | 0.34 | 0.01 | 81.22 |
| Example 2 | 13.61 | 0.60 | 0.04 | 84.13 |
| Example 3 | 10.41 | 0.44 | 0.00 | 83.50 |
| Example 4 | 10.32 | 0.44 | 0.00 | 77.97 |

As is clear from Table 2 and Table 3, in the examples 1-4, the faraday efficiencies were significantly high values of approximately 80%. In other words, by using the cathode electrode having the gallium oxide region, formic acid was generated selectively with high efficiency as the carbon dioxide reduction product. In the example 1, the electrolysis time was 6,934 seconds. The production amount of hydrogen was 26.67 μmol, and the production amount of carbon monoxide was 0.71 μmol. The production amount of formic acid was 168.3 μmol.

INDUSTRIAL APPLICABILITY

The present invention provides a novel apparatus and a novel method for generating formic acid as a carbon dioxide reduction product.

REFERENTIAL SIGNS LIST

1 pipe
11 first electrolyte solution
12 cathode container
13 cathode electrode
14 second electrolyte solution
15 anode container
16 solid electrolyte membrane
17 anode electrode
18 external power supply
29 reference electrode
100, 200 formic acid generation apparatus

The invention claimed is:

1. A method for generating formic acid by reducing carbon dioxide, the method comprising:

(a) preparing a formic acid generation apparatus comprising:

a cathode container storing a first electrolyte solution containing consisting of carbon dioxide, water and a first electrolyte:

an anode container storing a second electrolyte solution; a solid electrolyte membrane sandwiched between the cathode container and the anode container;

a cathode electrode provided in the cathode container so as to be in contact with the first electrolyte solution, the cathode electrode having a gallium oxide region on a surface thereof;

an anode electrode provided in the anode container so as to be in contact with the second electrolyte solution; and an external power supply for applying a negative voltage and a positive voltage to the cathode electrode and the anode electrode, respectively; and (b) after (a), applying a negative voltage and a positive voltage to the cathode electrode and the anode electrode, respectively, using the external power supply to generate formic acid on the cathode electrode using the first electrolyte solution.

2. The method according to claim 1, wherein the first electrolyte is potassium chloride or sodium chloride.

3. The method according to claim 1, wherein the second electrolyte solution is a sodium hydroxide aqueous solution or a potassium hydrogen carbonate aqueous solution.

* * * * *